US012022966B2

(12) United States Patent
Ceja

(10) Patent No.: US 12,022,966 B2
(45) Date of Patent: Jul. 2, 2024

(54) REINFORCEMENT TRAINING APPARATUS

(71) Applicant: Victor Ceja, Suisun City, CA (US)

(72) Inventor: Victor Ceja, Suisun City, CA (US)

( * ) Notice: Subject to any disclaimer, the term of this patent is extended or adjusted under 35 U.S.C. 154(b) by 271 days.

(21) Appl. No.: 17/667,065

(22) Filed: Feb. 8, 2022

(65) Prior Publication Data

US 2023/0248162 A1 Aug. 10, 2023

(51) Int. Cl.

| | |
|---|---|
| ***A47G 19/02*** | (2006.01) |
| ***A47G 19/23*** | (2006.01) |
| ***B65D 21/02*** | (2006.01) |

(52) U.S. Cl.

CPC ..... *A47G 19/025* (2013.01); *A47G 19/23* (2013.01); *B65D 21/0233* (2013.01); *A47G 2200/106* (2013.01)

(58) Field of Classification Search

CPC ..... A47G 19/025; A47G 19/23; A47G 2200/106; B65D 21/0233

See application file for complete search history.

(56) References Cited

U.S. PATENT DOCUMENTS

| | | | | |
|---|---|---|---|---|
| 2,224,683 | A * | 12/1940 | Ide | A47G 19/025 428/35.8 |
| 2,485,922 | A * | 10/1949 | Rubin | A47G 19/027 126/246 |
| 2,514,094 | A * | 7/1950 | Rubin | A47G 19/025 40/324 |
| 6,464,078 | B1 * | 10/2002 | Grossnickle | B43M 99/00 206/214 |
| 7,673,750 | B1 * | 3/2010 | Huckert | A47G 19/025 206/542 |
| 7,673,753 | B1 * | 3/2010 | Huckert | A47G 19/025 206/541 |
| 9,150,330 | B1 | 10/2015 | Stravitz | |
| 2002/0096528 | A1 * | 7/2002 | Fernandez | A47G 19/025 220/574 |

(Continued)

FOREIGN PATENT DOCUMENTS

| | | |
|---|---|---|
| CN | 203059332 | 10/2012 |
| CN | 106030129 | 11/2014 |
| GB | 2496364 | 8/2011 |

OTHER PUBLICATIONS

Oxo, Good Grips Salad Container, www.amazon.com, Sep. 1, 2015.

(Continued)

*Primary Examiner* — Gary C Hoge

(74) *Attorney, Agent, or Firm* — L/O ALEXIS J. SAENZ

(57) ABSTRACT

A system provides behavior therapy by including separate compartments, where one compartment holds an object visibly positioned as a reward for clearing an objective. The system includes a first receptacle. A second receptacle is coupled to the first receptacle. The second receptacle includes a compartment for receiving the object. Access to the compartment in the second receptacle is obstructed by a wall of the first receptacle. The apparatus further includes a magnetic lock. Access to the compartment in the second receptacle is provided in the event the magnetic lock is opened. The system further includes a magnetic key including a third magnet. When the magnetic key is placed proximate to the magnetic lock, the third magnet displaces the first magnet from the magnetic attraction to the second magnet to open the magnetic lock.

19 Claims, 10 Drawing Sheets

(56) References Cited

U.S. PATENT DOCUMENTS

| | | | | |
|---|---|---|---|---|
| 2004/0099544 | A1 | 5/2004 | Ness et al. | |
| 2005/0051549 | A1* | 3/2005 | Nelson | B65D 81/3216 220/23.83 |
| 2013/0001894 | A1 | 7/2013 | Parsons | |
| 2013/0213960 | A1* | 8/2013 | Cook | A47G 19/2205 220/23.87 |
| 2017/0021966 | A1 | 1/2017 | Parikh | |
| 2017/0232318 | A1* | 8/2017 | Topolosky | B65D 21/0233 220/737 |

OTHER PUBLICATIONS

Long, Tran; Yanko Design, the Perfect Cereal Bowl, Jul. 29, 2008.
The Crunch Cup, Aug. 5, 2021.

* cited by examiner

REINFORCEMENT TRAINING APPARATUS

CROSS-REFERENCE TO RELATED APPLICATION

None.

FIELD

The subject disclosure relates to training equipment, and more particularly, to a behavior therapy or contingency management apparatus.

BACKGROUND

All parents have at some point struggled with feeding their children; some parents struggle more than others, but from eating broccoli to eating carrots, not every parent is fortunate enough to have a child that loves to try new foods. The importance of nutritional feeding in children is vital. Having a broad repertoire of food intake can be the difference between a healthier child or a child with vitamin deficiencies or worse, other health-related illnesses, or even food disorders. At the time of this writing, a behavior therapy session with a professional could cost $120 dollars per hour.

As can be seen, there is a need for a device that provides assistance training children to eat their food.

SUMMARY

In one aspect of the disclosure, an apparatus for behavior therapy or contingency management is disclosed. The apparatus includes a first receptacle. A second receptacle is coupled to the first receptacle. The second receptacle includes a compartment for receiving an object. Access to the compartment in the second receptacle is obstructed by a wall of the first receptacle. The apparatus further includes a magnetic lock wherein access to the compartment in the second receptacle is provided in the event the magnetic lock is opened.

In another aspect, an apparatus for behavior therapy or contingency management is disclosed. The apparatus includes a bowl or plate configured to carry a foodstuff. The receptacle is coupled to the bowl or plate. The receptacle includes a compartment for receiving an object. Access to the compartment in the receptacle is obstructed by a bottom wall of the bowl or plate. A clear window in the receptacle is disposed to display the object in the compartment as an incentive to clear the foodstuff from the bowl or plate. A latch and detent to receive the latch are coupled to the bowl/plate and to the receptacle. A magnetic lock is coupled to the bowl or plate and coupled to the receptacle. In the event the magnetic lock is opened, the latch releases from the detent, and access to the compartment in the receptacle is provided in the event the magnetic lock is opened.

In yet another aspect of the disclosure, a system for behavior therapy or contingency management is disclosed. The system includes a first receptacle. A second receptacle is coupled to the first receptacle. The second receptacle includes a compartment for receiving an object. Access to the compartment in the second receptacle is obstructed by a wall of the first receptacle. The system further includes a magnetic lock wherein access to the compartment in the second receptacle is provided in the event the magnetic lock is opened. The magnetic lock includes a first magnet and a second magnet disposed in magnetic attraction to the first magnet. The system further includes a magnetic key included as third magnet. When the magnet key is placed proximate to the magnetic lock, the third magnet displaces the first magnet from the magnetic attraction to the second magnet to open the magnetic lock.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technique and technology. Accordingly, the drawings and detailed description are to be regarded as illustrative in nature and not as restrictive.

DETAILED DESCRIPTION

The detailed description set forth below is intended as a description of various configurations of the subject technique and technology and is not intended to represent the only configurations in which the subject technology may be practiced. The appended drawings are incorporated herein and constitute a part of the detailed description. The detailed description includes specific details for the purpose of providing a thorough understanding of the subject technique and technology. However, it will be apparent to those skilled in the art that the subject technology may be practiced without these specific details. Like or similar components are labeled with identical element numbers for ease of understanding.

In general, and referring to the Figures, embodiments of the subject technology comprise a device and system that is useful in the field of behavior therapy or contingency management. In one aspect, the apparatus is designed to hold an object that the subject being trained would want. For example, a toy may be placed in a compartment. The compartment is sealed off by another obstructing barrier so that the subject being trained must clear a goal before being allowed access to the compartment holding the toy. The apparatus offers parents a tool that can facilitate the modification of the eating behavior, especially during the early stages of development. In one aspect, the apparatus provides a tool for behavior therapy to all parents at an affordable cost and without the need to have a professional with them at all times.

Figure 1:
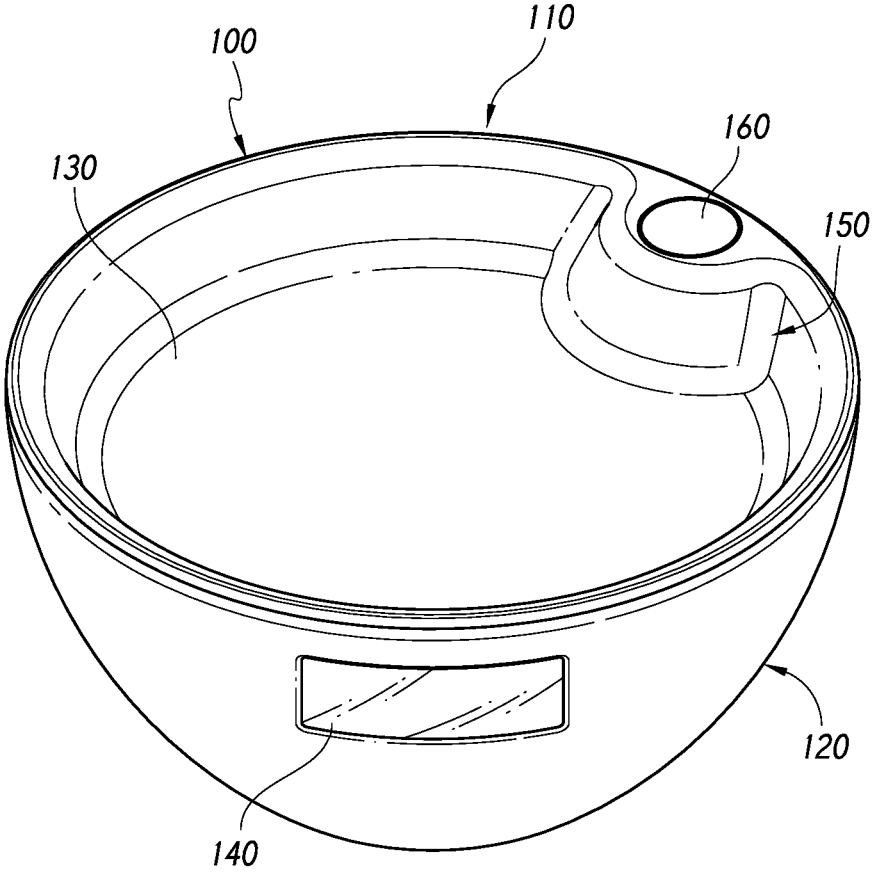
FIG. 1 is a front perspective view of a reinforcement training device in accordance with an aspect of the subject.
Figure 2:
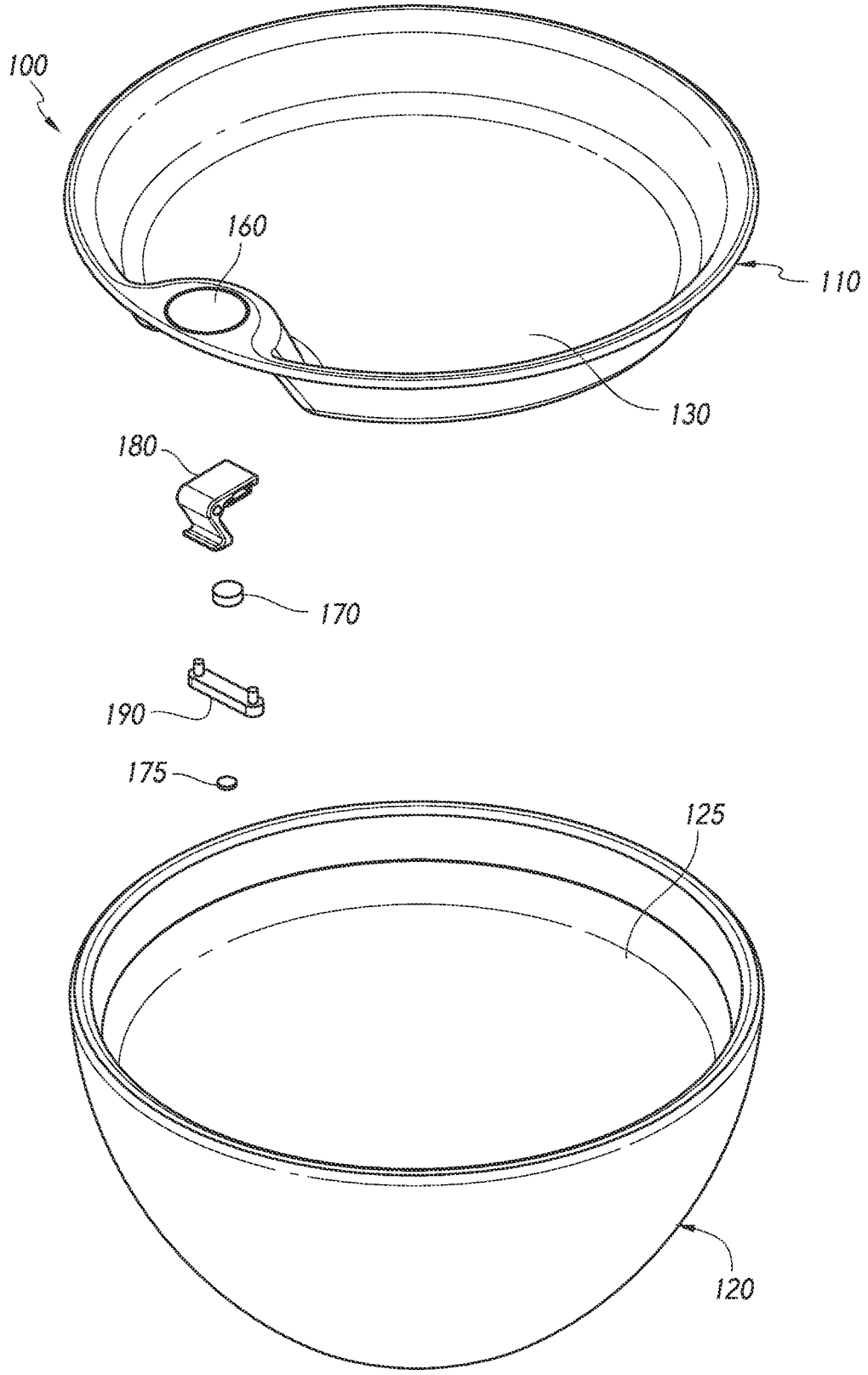
FIG. 2 is an exploded view of the device of FIG. 1.
Figure 3:
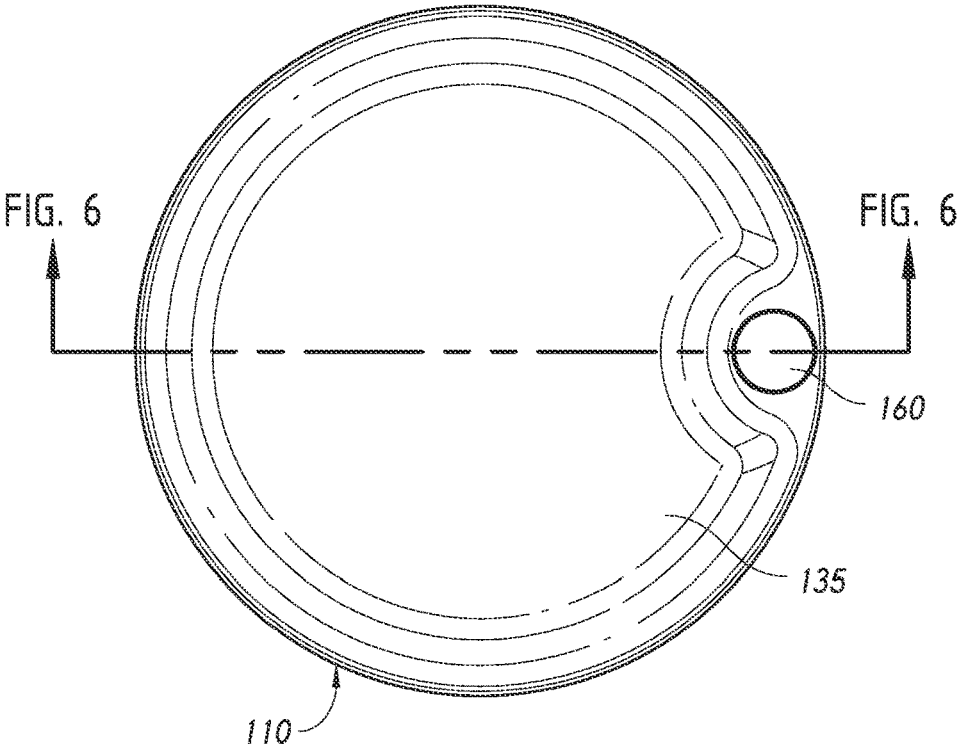
FIG. 3 is a top view of the device of FIG. 1.
Figure 4:
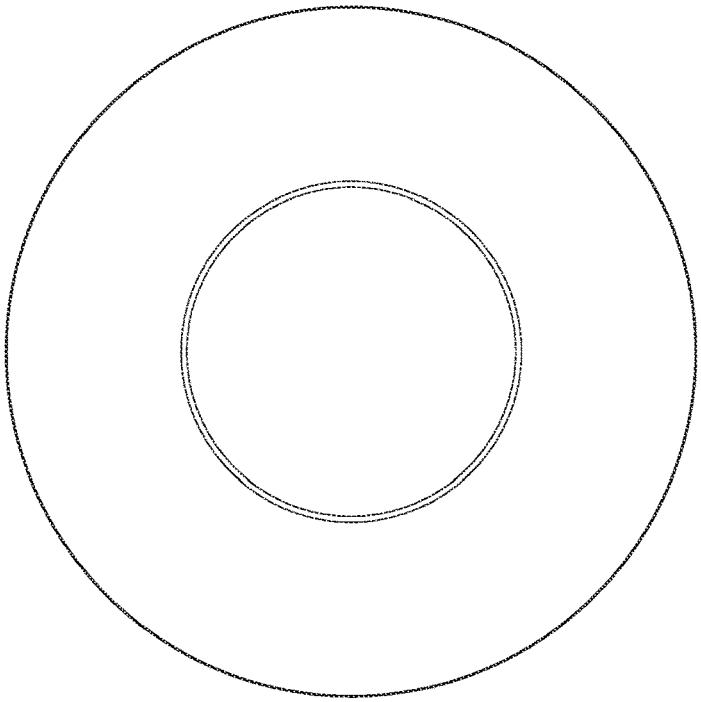
FIG. 4 is a bottom view of the device of FIG. 1.
Figure 5:
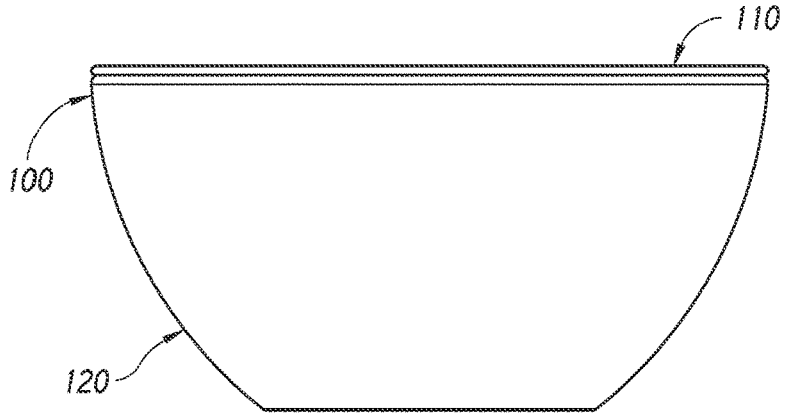
FIG. 5 is a side view of the device of FIG. 1.
Figure 6:
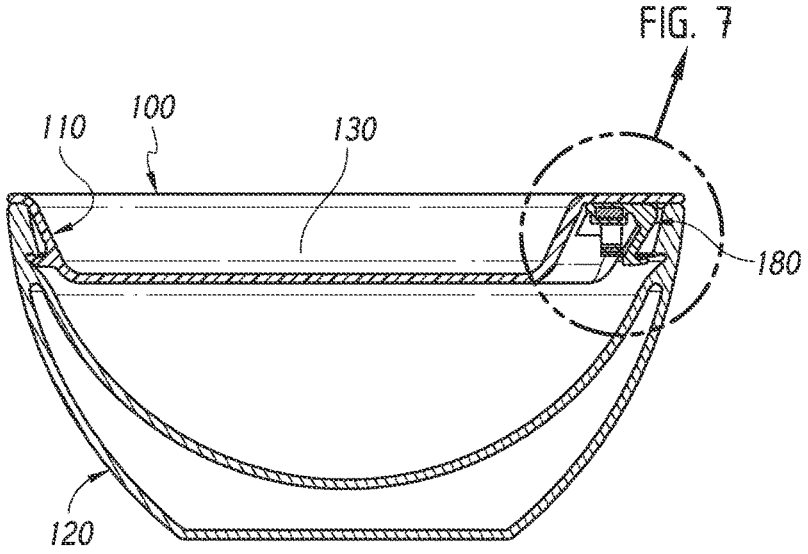
FIG. 6 is a side cross-sectional view taken along the line 6-6 of FIG. 3 in accordance with some embodiments.
Figure 7:
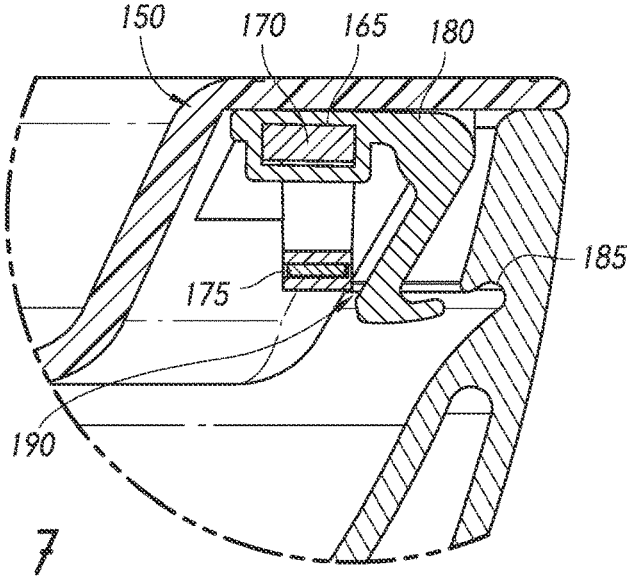
FIG. 7 is an enlarged view of the circle 7 of FIG. 6, in an unlocked position, in accordance with embodiments.

Referring now to FIGS. 1-7, an apparatus 100 is shown according to an illustrative embodiment. In some embodiments, the apparatus 100 is configured to modify eating habits. In general, a foodstuff may be set into one area of the apparatus 100 and cleared so that access to an interior compartment becomes available. A magnetic latch 160 assembly prevents access to the interior of the apparatus 100. The magnetic latch assembly 160 serves as an active tool in the process of training behavior. For example, the subject being trained may see the object as a reward within the apparatus 100 interior. The subject learns that the contingency involves eating the food that is in the way of reaching the reward. Before being able to use the magnetic latch assembly 160, (or someone else operating the magnetic latch assembly 160), the subject must clear the goal. In some embodiments while the subject being trained is clearing the goal (for example, eating), the subject is able to reinforce that training by constantly being presented with a view of the reward. As will be appreciated, if the food stuff is not cleared, access to the interior of the apparatus 100 may become undesirable because the foodstuff will cause a mess if not first cleared. As will be understood, for sake of illustration, the foodstuff and the object being placed into the apparatus interior are not shown since they can be any foodstuff or object and the foodstuff or object are not necessarily part of the invention.

The apparatus 100 generally includes a first receptacle 110 and a second receptacle 120. The first receptacle 110 is generally positioned in an obstructing disposition relative to the interior of the receptacle 120. For example, the first receptacle 110 may be in front of or on top of the second receptacle 120. The first receptacle 110 may be a plate or bowl. In one embodiment, the first receptacle 110 is nested within the second receptacle 120 so that the bottom wall 130 of the first receptacle 110 is a barrier to access the interior 125 of the second receptacle until the first receptacle 110 is removed from the nested position. When the first receptacle 110 is in its obstructing state, the space between the wall 130 and the interior space 125 forms a compartment for receipt of the object being used as a reward. See for example FIG. 6. The second receptacle 120 may include a clear window 140 or its sidewall may be transparent so that the object in the compartment is visible to the subject being trained. As the subject being trained, eats their food for example, the object remains on display as an incentive to finish the goal of eating their food.

In an illustrative embodiment, the apparatus 100 includes the magnetic latch assembly 160 coupling the first receptacle 110 to the second receptacle 120. Some embodiments include a magnetic latch assembly compartment 150 housing the locking elements of the magnetic latch assembly 160 to the first receptacle 110 and the second receptacle 120. The magnetic latch assembly 160 may include two magnets 170 and 175 positioned in cooperation to hold a locking mechanism into place. Magnet 175 is carried by a mount 190. It is embedded or placed on top of mount 190 so that it creates that magnetic force to lock the latch automatically, making it easier for parents or children to place the top plate (first receptacle) 110 in any position on top of receptacle 120. The locking mechanism may include for example, a latch 180 that includes a hooked end that is receivable within a detent (or catch or groove) 185. The detent 185 may be positioned on an interior wall proximate an edge of the second receptacle 120. The opposite end of the latch 180 may include a compartment 165 for holding the primary magnet 170. The mount 190 may include two posts. The secondary magnet 175 may be positioned in the center of the mount 190 body. The magnet 175 in the mount 190 is positioned in alignment with the magnet 170 to the generate a magnetic field attraction between to two magnets. The two posts provide the surrounding support structure to hold magnet 170 between or inside mount 190. The mount 190 may be hollow so as to hold the magnet 170 inside. The posts may have a second thin layer to hold the magnet 170 inside the mount 190.

When the elements of the magnetic latch assembly 160 are positioned into place, the latch 180 is set within the detent 185 which secures the first receptacle 110 to the second receptacle 120. As will be discussed further below, access to the second receptacle 120 is performed by disengaging the primary magnet 170 from its magnetic attraction to the secondary magnet 175. In some embodiments, a magnetic key (see below) is used to operate the magnetic latch assembly 160 to move the primary magnet 170 from its position to break the magnetic attraction. In the event the magnetic field is broken, the latch 180 may be shifted out of securement from the detent 185 releasing the first receptacle 110 from the second receptacle 120.

Figure 8:
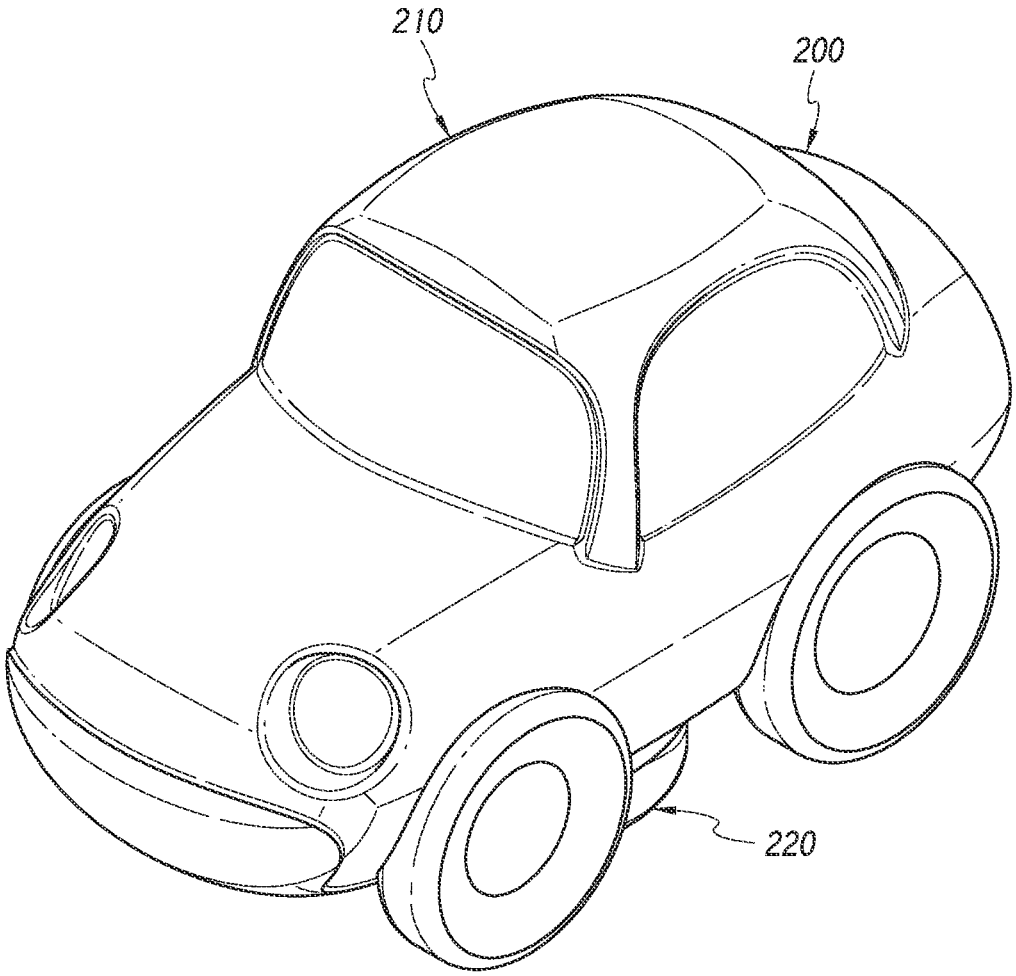
FIG. 8 is a front perspective view of a reinforcement training device in accordance with another embodiment.
Figure 9:
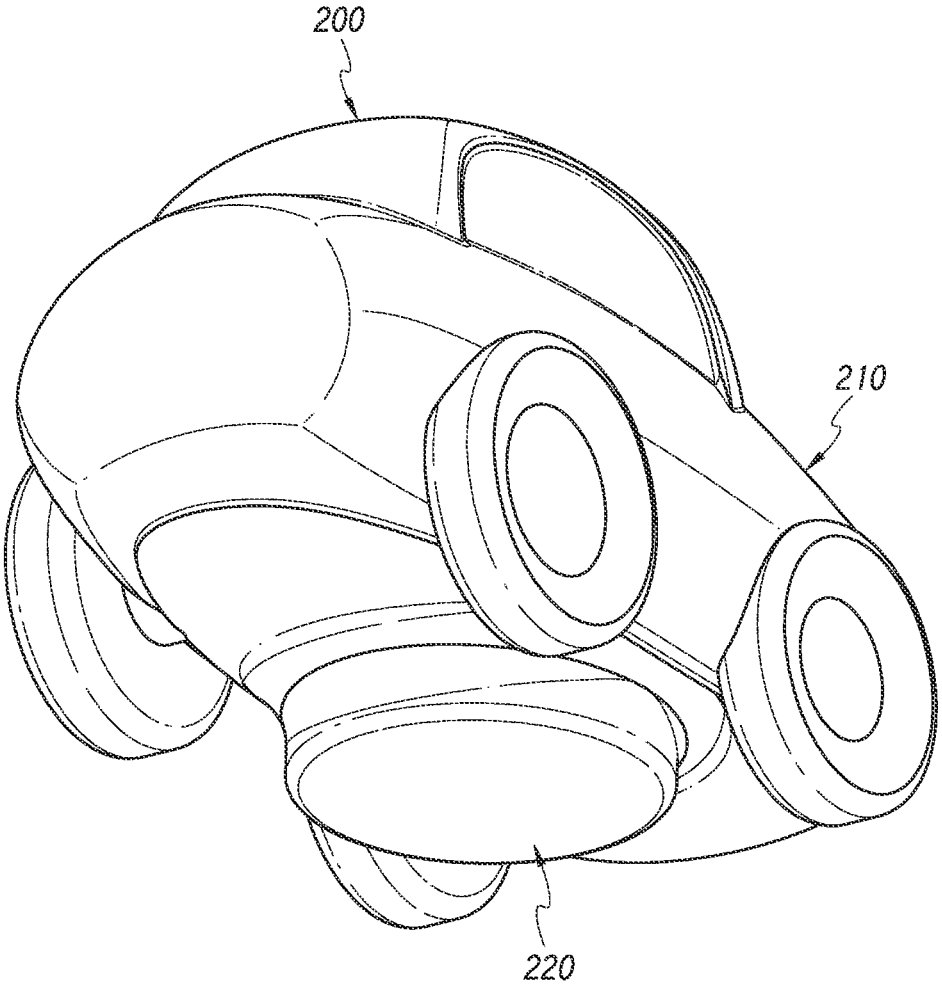
FIG. 9 is a bottom perspective view of the device of FIG. 8.
Figure 10:
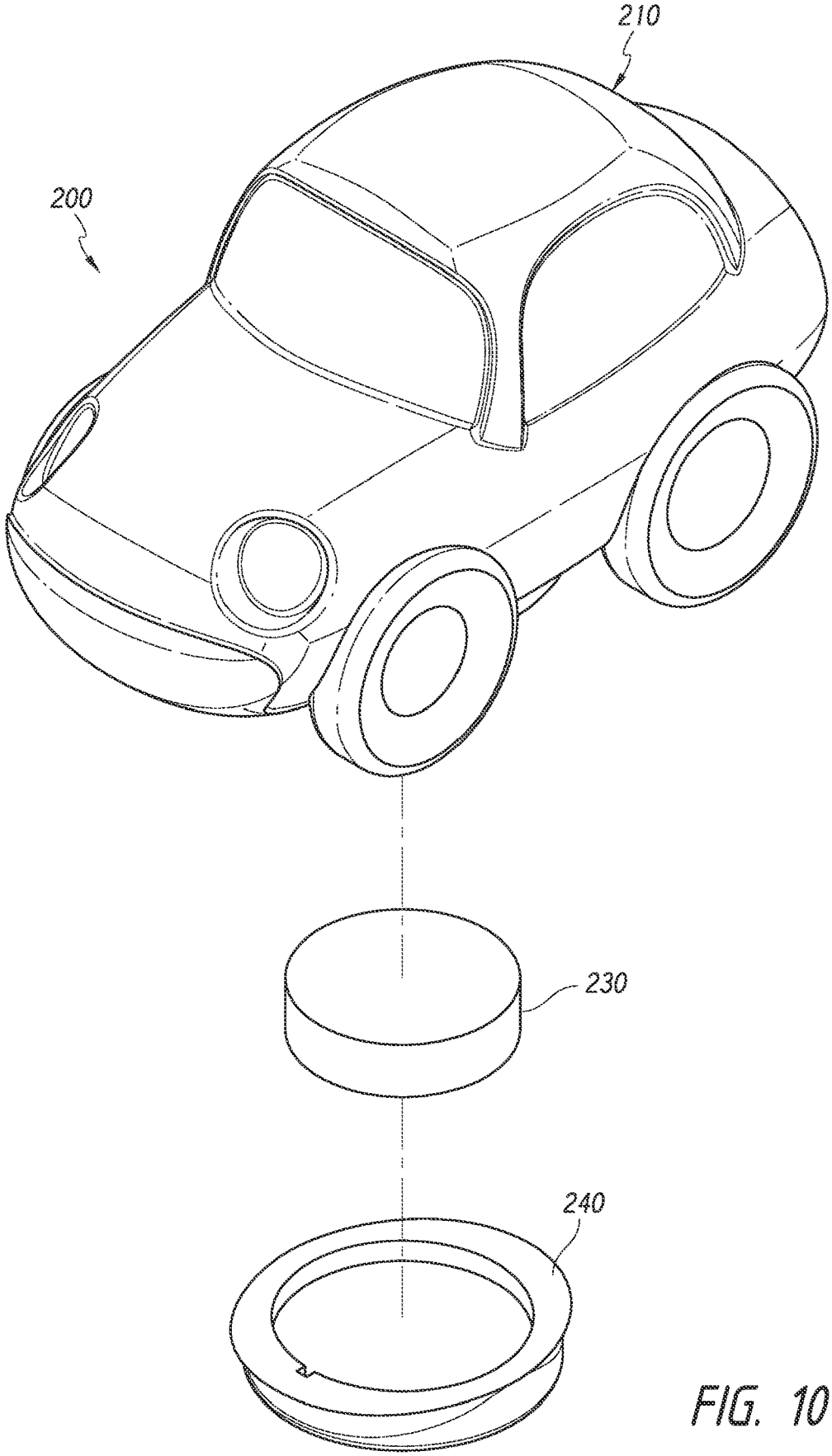
FIG. 10 is an exploded view of the device of FIG. 8.
Figure 11:
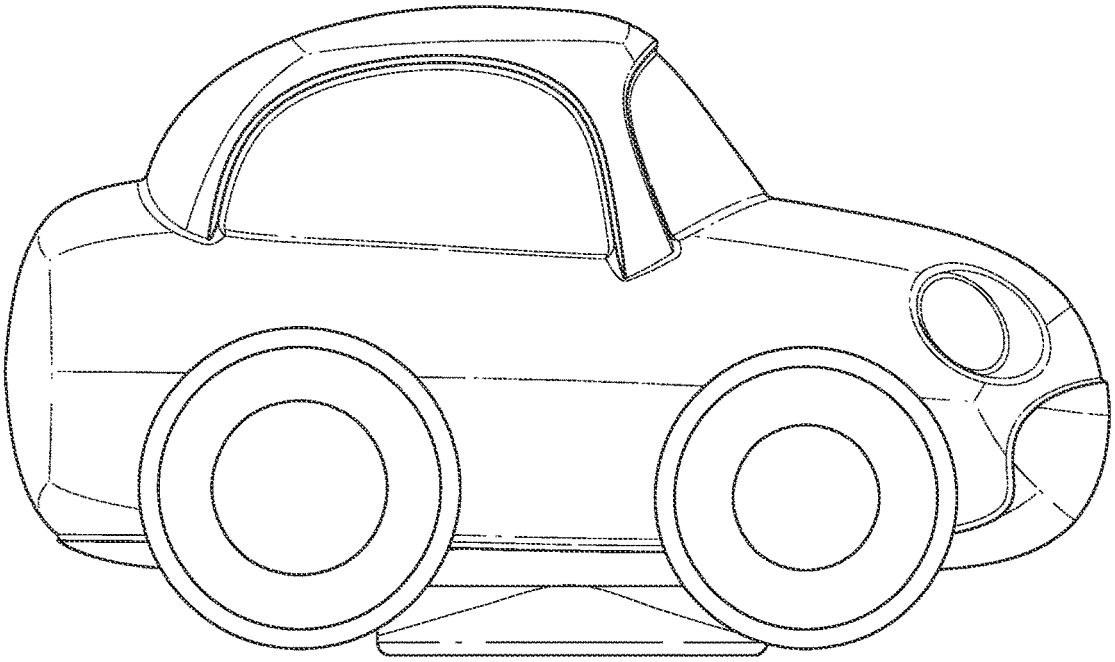
FIG. 11 is a right side view of the device of FIG. 8.
Figure 12:
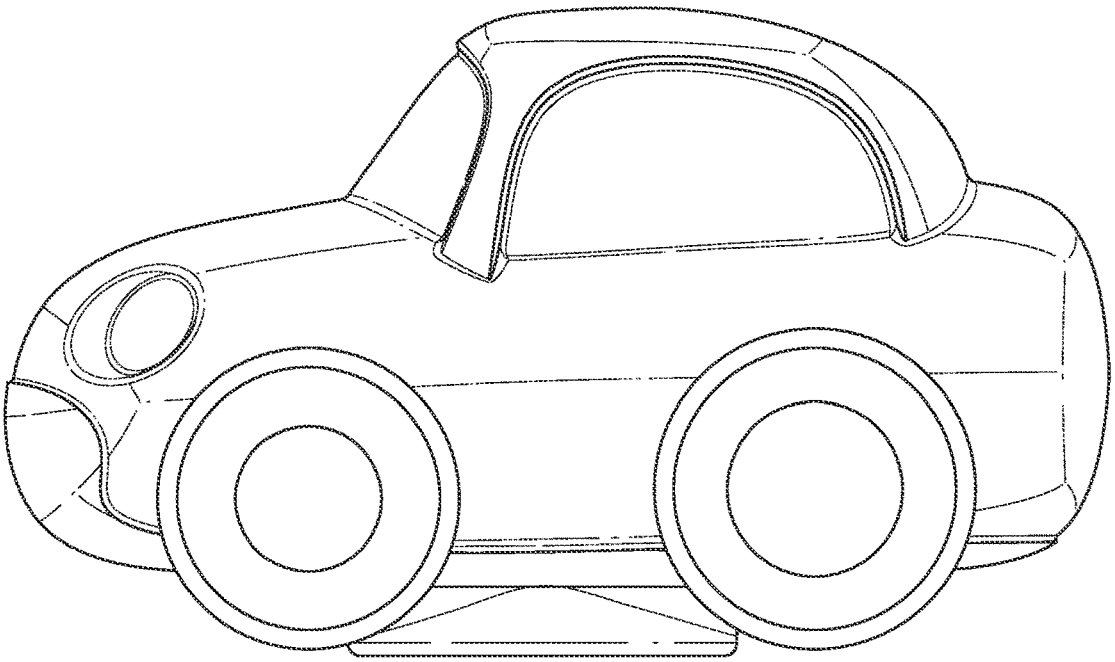
FIG. 12 is a left side view of the device of FIG. 8.
Figure 13:
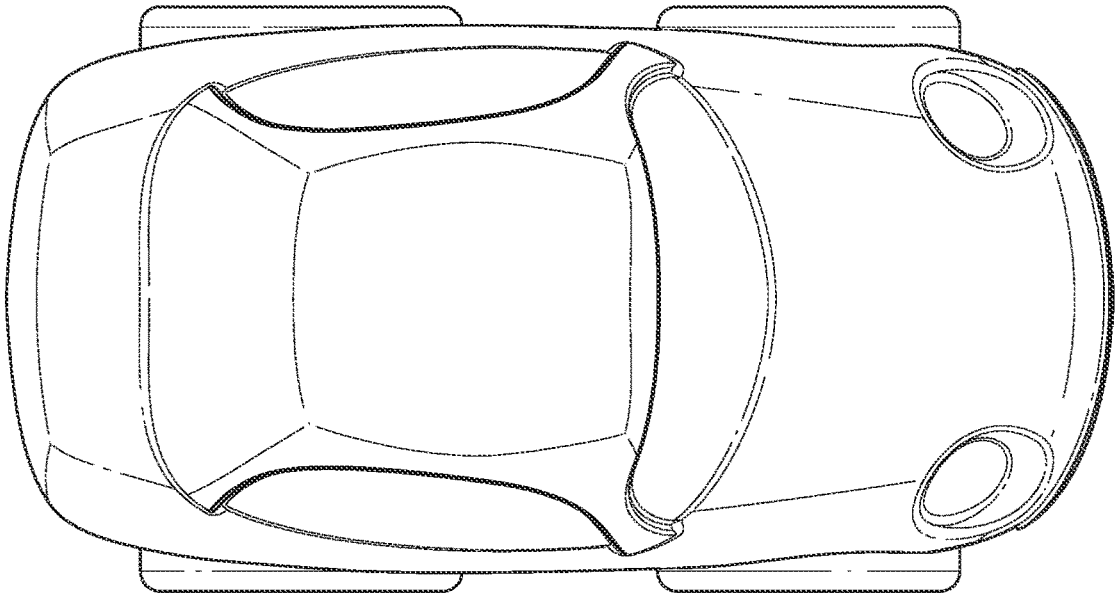
FIG. 13 is a top view of the device of FIG. 8.
Figure 14:
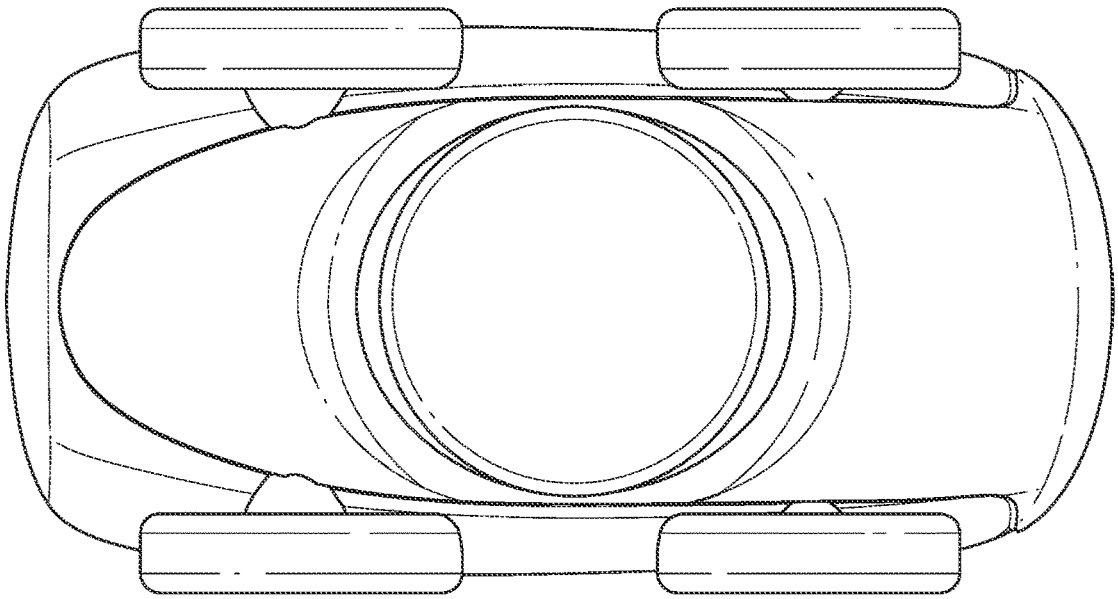
FIG. 14 is a bottom view of the device of FIG. 8.
Figure 15:
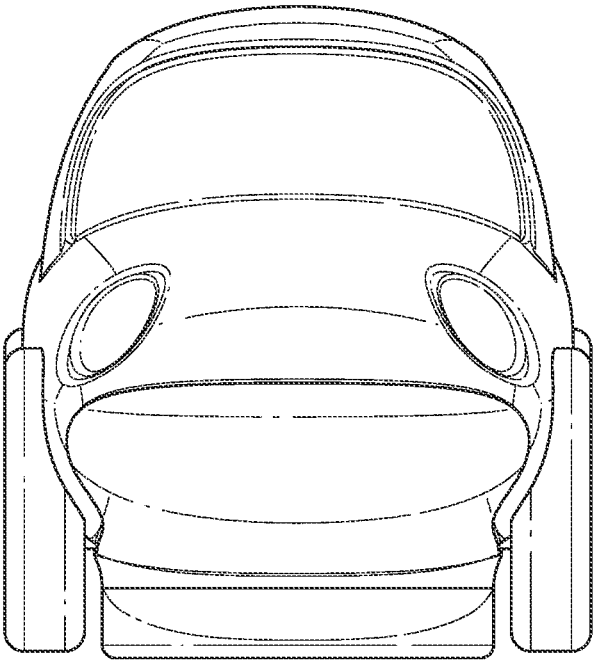
FIG. 15 is a front view of the device of FIG. 8.

FIGS. 8-15 show a magnetic key device 200 according to an illustrative embodiment. As will be appreciated, the magnetic key device 200 may include handle 210 that resembles an object of novelty. As shown, the handle 210 may resemble a toy car however it will be understood that the handle 210 may be shaped in any various ornamental configurations as desired. The magnetic key device 200 may include a magnet hub 220. The magnet hub 220 may house a magnet 230. The magnet 230 may be held into place within the hub 220 by a cap 240. The magnet 230 may have a stronger magnetic force than the magnet 175. The magnet 170 is pulled or attracted to the stronger force of magnet 230. When magnet 230 is not present, magnet 170 with the attraction of 175, the latch 180 swings back unlocking from the groove or channel.

Referring to FIGS. 1-15 in general, in operation, the magnet hub 220 may be placed against the top surface of the magnetic latch assembly 160. When the user feels the magnetic attraction between the magnet 170 in the magnetic latch assembly 160 and the magnet 230 in the magnetic key device 200, the user may move the magnetic key device 200 laterally to displace the magnet 170 and latch 180 from its position within the detent 185, thus releasing the securing arrangement of the first receptacle 110 from the second receptacle 120. The subject being trained may then gain access to the object placed inside the second receptacle 120 as a reward.

Those of skill in the art would appreciate that various components may be arranged differently (e.g., arranged in a different order, or partitioned in a different way) all without departing from the scope of the subject technique or technology.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technique and technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technique or technology or that such embodiment applies to all configurations of the subject technique or technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An apparatus for behavior therapy or contingency management, comprising:

a first receptacle;

a second receptacle coupled to the first receptacle, wherein the second receptacle includes a compartment for receiving an object, and access to the compartment in the second receptacle is obstructed by a wall of the first receptacle; and a magnetic lock coupled to the first receptacle and to the second receptacle, wherein access to the compartment in the second receptacle is provided in the event the magnetic lock is opened.

2. The apparatus of claim 1, wherein the first receptacle is configured to carry a foodstuff.

3. The apparatus of claim 1, wherein the first receptacle is a bowl.

4. The apparatus of claim 3, wherein the second receptacle includes a clear window disposed to display the object in the compartment as an incentive to clear the foodstuff from the bowl.

5. The apparatus of claim 1, wherein the first receptacle is a plate.

6. The apparatus of claim 1, wherein the second receptacle includes a clear window disposed to display the object in the compartment as an incentive to clear the foodstuff from the bowl.

7. The apparatus of claim 1, wherein the first receptacle is configured to nest within the second receptacle.

8. The apparatus of claim 1, further comprising:

a latch coupled to either the first receptacle or the second receptacle; and a detent in either the first receptacle or the second receptacle, configured to receive the latch, wherein in the event the magnetic lock is opened, the latch releases from the detent.

9. The apparatus of claim 1, wherein the magnetic lock includes a magnet disposed to slide from a first position, in a locked state, to a second position, in an unlocked state.

10. An apparatus for behavior therapy or contingency management, comprising:

a bowl or plate configured to carry a foodstuff;

a receptacle coupled to the bowl or plate, wherein the receptacle includes:

a compartment for receiving an object, and access to the compartment in the receptacle is obstructed by a bottom wall of the bowl or plate, and a clear window disposed to display the object in the compartment as an incentive to clear the foodstuff from the bowl or plate;

a latch coupled to either the bowl, the plate or to the receptacle; and a detent in either the bowl, the plate, or the receptacle, configured to receive the latch, a magnetic lock coupled to the bowl or plate and coupled to the receptacle, wherein: in the event the magnetic lock is opened, the latch releases from the detent, and access to the compartment in the receptacle is provided in the event the magnetic lock is opened.

11. The apparatus of claim 10, wherein the bowl or plate is configured to nest within the receptacle.

12. A system, comprising:

a first receptacle;

a second receptacle coupled to the first receptacle, wherein the second receptacle includes a compartment for receiving an object, and access to the compartment in the second receptacle is obstructed by a wall of the first receptacle;

a magnetic lock coupled to the first receptacle and to the second receptacle, wherein:

the magnetic lock includes a first magnet and a second magnet disposed in magnetic attraction to the first magnet, and access to the compartment in the second receptacle is provided in the event the magnetic lock is opened; and a magnet key including a third magnet, wherein in the event the magnet key is placed proximate the magnetic lock, the third magnet displaces the first magnet from the magnetic attraction to the second magnet to open the magnetic lock.

13. The system of claim 12, wherein the first receptacle is configured to carry a foodstuff.

14. The apparatus of claim 12, wherein the first receptacle is a plate or a bowl.

15. The apparatus of claim 14, wherein the second receptacle includes a clear window disposed to display the object in the compartment as an incentive to clear the foodstuff from the bowl.

16. The apparatus of claim 12, wherein the first receptacle is configured to nest within the second receptacle.

17. The apparatus of claim 12, further comprising:

a latch coupled to either the first receptacle or the second receptacle; and a detent in either the first receptacle or the second receptacle, configured to receive the latch, wherein in the event the magnetic lock is opened, the latch releases from the detent.

18. The apparatus of claim 1, wherein the second receptacle is transparent.

19. The system of claim 12, wherein the second receptacle is transparent.

* * * * *